US009914068B2

(12) United States Patent
Wood et al.

(10) Patent No.: US 9,914,068 B2
(45) Date of Patent: Mar. 13, 2018

(54) TOY STRUCTURE KIT WITH A CONNECTOR AND ACCESSORIES

(71) Applicant: Mattel, Inc., El Segundo, CA (US)

(72) Inventors: Ethan K. Wood, Hermosa Beach, CA (US); Rawn Trinidad, San Pedro, CA (US); Nicole Luo, Shen Zhen (CN); Tai To Lee, San Po Kong (HK); Xuan Liang, Lei Zhou (CN); Leo Shen, Shen Zhen (CN); Chun Kit Ho, Rosemead, CA (US)

(73) Assignee: Mattel, Inc., El Segundo, CA (US)

( * ) Notice: Subject to any disclaimer, the term of this patent is extended or adjusted under 35 U.S.C. 154(b) by 260 days.

(21) Appl. No.: 14/485,347

(22) Filed: Sep. 12, 2014

(65) Prior Publication Data

US 2017/0304740 A1 Oct. 26, 2017

Related U.S. Application Data

(60) Provisional application No. 61/877,661, filed on Sep. 13, 2013, provisional application No. 61/982,150, filed on Apr. 21, 2014.

(51) Int. Cl.
*A63H 3/16* (2006.01)
*A63H 33/06* (2006.01)

(52) U.S. Cl.
CPC ..... *A63H 33/06* (2013.01)

(58) Field of Classification Search
CPC ..... F16B 21/073; F16B 21/086; G09F 3/14; Y10T 403/57; Y10T 403/5706; Y10T 403/5741; Y10T 24/44026; Y10T 24/302; Y10T 24/303; Y10T 24/309; A63H 33/00; A63H 33/03; A63H 33/05
See application file for complete search history.

(56) References Cited

U.S. PATENT DOCUMENTS 1,120,331 A 12/1914 Parsons
1,176,209 A 3/1916 Dice
1,208,029 A 12/1916 Smith
(Continued)

FOREIGN PATENT DOCUMENTS

DE 3524467 A1 1/1986
DE 4229798 A1 3/1994
(Continued)

OTHER PUBLICATIONS

DISPLAYS2GO, "3/4×3/4 Through Grip Standoffs, Round, Aluminum—Gray", available online at <http://www.displays2go.com/P-19529/Sign-Spacers-Feature-A-Titanium-Finish-Set-of-Four>, 2014, 4 pages.

*Primary Examiner* — John E Simms, Jr.
*Assistant Examiner* — Urszula M Cegielnik
(74) *Attorney, Agent, or Firm* — Kolisch Hartwell, P.C.

(57) ABSTRACT

The toy structure kit includes an accessory defining an opening, a toy structure defining an opening, and a connector having a base member and a collar, the connector configured to couple the accessory to the toy structure, the base member including a first projection member and a second projection member, the first projection member configured to extend through the opening defined by the accessory and receive the collar, the second projection member configured to extend through the opening defined by the toy structure.

20 Claims, 19 Drawing Sheets

(56) References Cited

U.S. PATENT DOCUMENTS 1,289,385 A 12/1918 Cabana
1,381,975 A * 6/1921 Dumais ..... G09F 3/14 292/307 R
1,456,422 A 5/1923 Cabana
2,001,334 A 5/1935 Stein
2,007,784 A 7/1935 Wittmann
2,019,516 A 11/1935 Weinberg
2,021,115 A 11/1935 Jackson
2,118,677 A 5/1938 Lower
2,118,682 A 5/1938 Nagel
2,149,254 A * 3/1939 Corswirt ..... A63H 3/16 446/387
2,160,739 A 5/1939 Hugus et al.
2,681,525 A * 6/1954 James ..... D04D 7/10 2/151
2,736,115 A * 2/1956 James ..... G09F 1/10 248/176.1
2,774,164 A * 12/1956 James ..... B65D 5/4262 223/46
2,799,970 A 7/1957 Baggott
2,806,313 A * 9/1957 James ..... D04D 7/10 40/1.5
2,862,321 A * 12/1958 James ..... D04D 7/10 206/231
2,869,264 A * 1/1959 Salmi ..... D04D 7/10 2/245
2,926,440 A * 3/1960 Gilbert ..... B65D 33/12 229/78.1
3,026,639 A * 3/1962 Lille ..... G09F 3/04 40/124.09
3,425,155 A 2/1969 Ryan et al.
3,628,282 A 12/1971 Johnson et al.
3,850,293 A * 11/1974 Scaringi ..... G09F 19/12 206/231
4,294,350 A * 10/1981 Haase ..... B65D 33/1616 206/216
4,499,678 A * 2/1985 Moreau ..... A63H 3/003 40/1.6
4,617,001 A 10/1986 Parein
4,627,640 A * 12/1986 Markovics ..... B42D 15/00 281/5
4,664,396 A * 5/1987 Pietrafesa ..... A63H 3/52 280/30
4,763,427 A * 8/1988 Schrager ..... B42D 15/045 40/124.08
4,900,632 A * 2/1990 McGrath ..... D04D 7/10 223/46
4,947,527 A 8/1990 Hennig
5,097,854 A * 3/1992 Smith ..... A45D 8/00 132/273
5,261,172 A * 11/1993 Rowley ..... G09F 1/08 40/124.08
5,301,396 A * 4/1994 Benoit ..... F16B 21/086 24/297
5,344,356 A * 9/1994 Pizzelli ..... A63H 3/36 428/100
5,448,846 A * 9/1995 Peterson ..... G09F 3/005 24/484
5,456,625 A 10/1995 Dumond
5,458,521 A * 10/1995 Todd ..... A63H 3/005 229/116.3
5,497,543 A * 3/1996 Cavender ..... A63H 9/00 29/469
5,503,311 A * 4/1996 Chen ..... A47G 25/28 223/85
5,577,644 A * 11/1996 Chen ..... A47G 25/005 223/85
5,695,380 A * 12/1997 Morrison ..... A63H 3/36 446/268
5,842,562 A * 12/1998 Bauman ..... A63H 3/005 206/566
5,888,595 A * 3/1999 Krattiger ..... G09F 1/08 40/124.08
5,890,498 A * 4/1999 Kawaguchi ..... A41G 5/004 132/275
5,911,227 A * 6/1999 Shweky ..... A45D 8/34 132/275
6,010,387 A * 1/2000 Nemec ..... A63H 3/10 428/100
6,199,912 B1 * 3/2001 Finkelshteyn ..... B42D 15/045 283/117
6,264,522 B1 7/2001 Dickson
6,277,452 B1 * 8/2001 Craig ..... B42D 15/045 428/133
6,296,366 B1 * 10/2001 Hopps ..... D04D 7/00 362/154
6,311,418 B1 * 11/2001 Crowell ..... G09F 1/08 283/117
6,401,488 B1 6/2002 Cousin et al.
6,537,131 B1 3/2003 Larian
6,991,510 B2 1/2006 Nan
7,013,591 B2 * 3/2006 Lee ..... G09F 13/00 40/124.191
7,017,239 B2 * 3/2006 Kurily ..... B60R 13/0206 24/297
7,222,399 B2 * 5/2007 Eisenbraun ..... A47F 5/0006 24/469
8,061,091 B2 * 11/2011 Botkin ..... F24J 2/5211 126/623
2002/0178626 A1 * 12/2002 Stefany ..... G09F 1/00 40/124.06
2004/0116041 A1 * 6/2004 Isenberg ..... A63H 3/02 446/331
2005/0051581 A1 3/2005 Nan
2005/0113177 A1 5/2005 Kuo
2006/0101679 A1 * 5/2006 Glenn ..... B65D 5/425 40/124.09
2007/0281582 A1 12/2007 Himstedt
2008/0081144 A1 4/2008 Kato
2008/0200095 A1 8/2008 Guenette et al.
2008/0268741 A1 10/2008 Pinsker
2009/0028667 A1 * 1/2009 Boubtane ..... F16B 19/008 411/508
2009/0238660 A1 * 9/2009 Homner ..... F16B 5/0642 411/508
2011/0116898 A1 * 5/2011 Malavasi ..... G02C 1/02 411/508
2011/0192195 A1 8/2011 Tsai
2012/0073032 A1 3/2012 Tigan et al.
2012/0309258 A1 12/2012 Hawthorne

FOREIGN PATENT DOCUMENTS

DE 69402535 T2 10/1997
EP 611320 A1 8/1994
EP 1064061 A1 1/2001
EP 1064062 A1 1/2001
EP 1839718 A1 10/2007
WO 1987/003502 A1 6/1987
WO 2008/000080 A1 1/2008
WO 2011/157061 A1 12/2011
WO 2013/004245 A1 1/2013

* cited by examiner

TOY STRUCTURE KIT WITH A CONNECTOR AND ACCESSORIES

CROSS-REFERENCE TO RELATED APPLICATIONS

This application claims priority under 35 U.S.C. § 119(e)(1), to U.S. Provisional Application Ser. Nos. 61/877,661, filed on Sep. 13, 2013 and 61/982,150, filed on Apr. 21, 2014, the entire contents of each of which are incorporated herein by reference.

FIELD

Embodiments relate to toy structures with attachable accessories.

BACKGROUND

Children play with toys and enjoy modifying or accessorizing them. However, typical accessories are in a fixed configuration and placed in a fixed position. For example, a toy hat accessory could be fixed on the head of a doll. Although, there may be many hats for the doll the hats themselves are fixed as manufactured. Further, it is unlikely the hat would be positioned on the doll other than on the head. Thus, there is a need for a toy that provides for modification, accessorizing, and customization by a child.

SUMMARY

One embodiment includes a toy structure kit. The toy structure kit includes an accessory defining an opening, a toy structure defining an opening, and a connector having a base member and a collar, the connector configured to couple the accessory to the toy structure, the base member including a first projection member and a second projection member, the first projection member configured to extend through the opening defined by the accessory and receive the collar, the second projection member configured to extend through the opening defined by the toy structure.

Implementations can include one or more of the following features. For example, the at least one accessory is one of a formable shape and a preconfigured shape. The at least one accessory is formed of paperboard including an ornamental covering. The toy structure is hollow three dimensional structure.

For example, the connector includes a flange, the first projection member is coupled to a first side of the flange, the second projection member is coupled to a second side of the flange, opposite the first projection member, and the flange is disposed perpendicular to the first projection member and the second projection member. For example, the connector includes a first flange and a second flange, the second projection member is coupled to a first side of the first flange, the first projection member is coupled a first side of the second flange, the second flange is coupled to a second side of the first flange opposite the second projection member, the first projection member and the first flange are disposed parallel to each other, and the first projection member and the second projection member are disposed perpendicular to each other.

For example, the first projection member includes one or more ribs, the collar includes one or more flexible flanges, and the one or more flexible flanges receive the one or more ribs when the first projection member in inserted into the opening defined by the collar. The second projection member includes a ring, the ring includes at least one flat surface, and the ring is configured to fix a position of the at least one accessory when the second projection member is inserted into the toy structure. The ring is configured to fix a rotational position of the at least one accessory when the second projection member is inserted into the toy structure. For example, the second projection member includes at least three sections, and the at least three sections are configured to help retain the second projection member in the toy structure. The at least three sections collectively define a void, the void is configured to contract while inserting the second projection member into the toy structure, and the void is configured to expand to an original size when the second projection member is inserted into the toy structure.

Another embodiment includes a method. The method includes inserting at least one toy accessory onto a first projection member of a connector, coupling a collar onto the first projection member, inserting a second projection member of the connector into a toy structure body, and positioning the toy accessory on the toy structure body.

Implementations can include one or more of the following features. For example, positioning the toy accessory structure is performed while inserting the second projection member into the toy structure body. Coupling the collar onto the first projection member includes pushing the collar onto the first projection member such that a flexible flange of the collar engages a rib of the first projection member. Coupling the collar onto the first projection member includes screwing the collar onto the first projection member. Positioning the toy accessory structure on the toy structure body can include rotating the toy accessory structure in relation to the toy structure body.

For example, inserting the at least one toy accessory onto the first projection member of the connector and coupling the collar onto the first projection member form a toy accessory structure, the method includes assembling a plurality of toy accessory structures, and repeating the inserting of the second projection member of the connector into the toy structure body and positioning of the toy accessory on the toy structure body for each of the plurality of accessory structures. For example, the method includes forming the at least one toy accessory into a shape.

For example, positioning the toy accessory on the toy structure body includes fixing the toy accessory in a first position, the method includes rotating the toy accessory to a second position, and fixing the toy accessory in the second position. For example, inserting the second projection member of the connector into the toy structure body includes punching the opening into the toy structure body using the second projection member.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limiting of the example embodiments and wherein.

Figure 1:
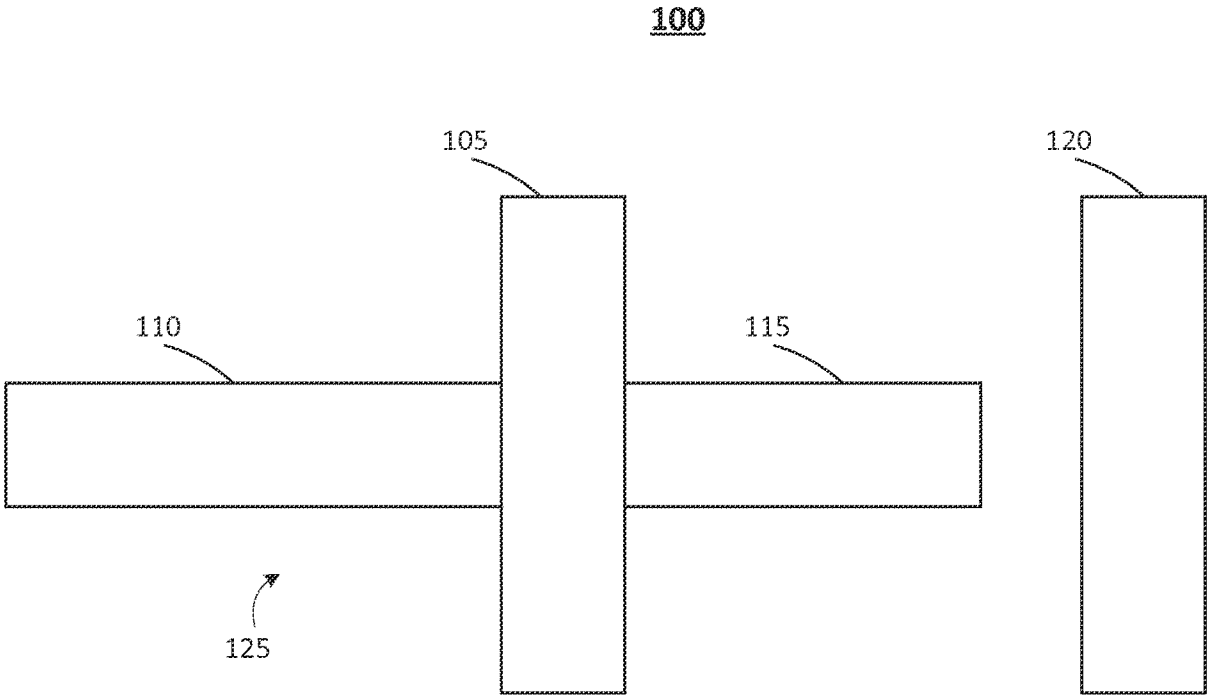
FIGS. 1-4 illustrate block diagrams of a connector according to at least one example embodiment.

It should be noted that these figures are intended to illustrate the general characteristics of methods, structure and/or materials utilized in certain example embodiments and to supplement the written description provided below.

DETAILED DESCRIPTION OF THE EMBODIMENTS

While example embodiments may include various modifications and alternative forms, embodiments thereof are shown by way of example in the drawings and will herein be described in detail. It should be understood, however, that there is no intent to limit example embodiments to the particular forms disclosed, but on the contrary, example embodiments are to cover all modifications, equivalents, and alternatives falling within the scope of the claims.

FIG. 1 illustrates a block diagram of a connector 100 according to at least one example embodiment. As shown in FIG. 1, the connector 100 includes a base member 125 and a collar 120. The base member 125 includes a flange 105, projection member 110 and projection member 115. The connector 100 may be configured to help maintain at least one accessory coupled (e.g., moveably coupled) to a toy structure. Connector 100 may be configured to couple the accessory parallel to the toy structure. The collar 120 may be configured to help maintain at least one accessory coupled between the flange 105 and the collar 120.

Figure 2:
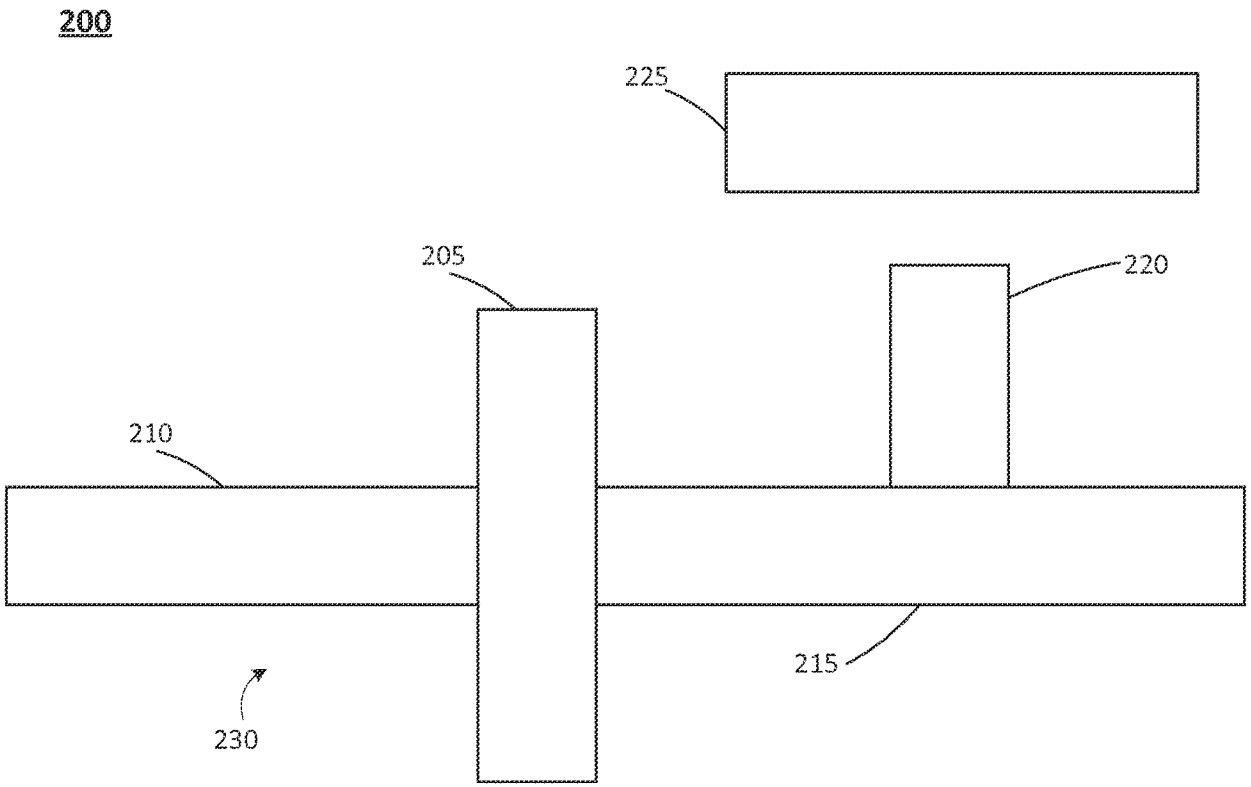

FIG. 2 illustrates another block diagram of a connector 200 according to at least one example embodiment. As shown in FIG. 2, the connector 200 includes a base member 230 and a collar 225. The base member 230 includes flanges 205 and 215 and projection members 210 and 220. The connector 200 may be configured to help maintain at least one accessory coupled (e.g., moveably coupled) to a toy structure. Connector 200 may be configured to couple the accessory at an angle to the toy structure. The collar 225 may be configured to help maintain at least one accessory coupled between the flange 215 and the collar 225. Although the example embodiment of the connector 200 shown in FIG. 2 is illustrated as having flange 215 and projection member 220, in an alternate implementation connector 200 may include a curved projection member or an angled projection member formed of at least one section.

Figure 3:
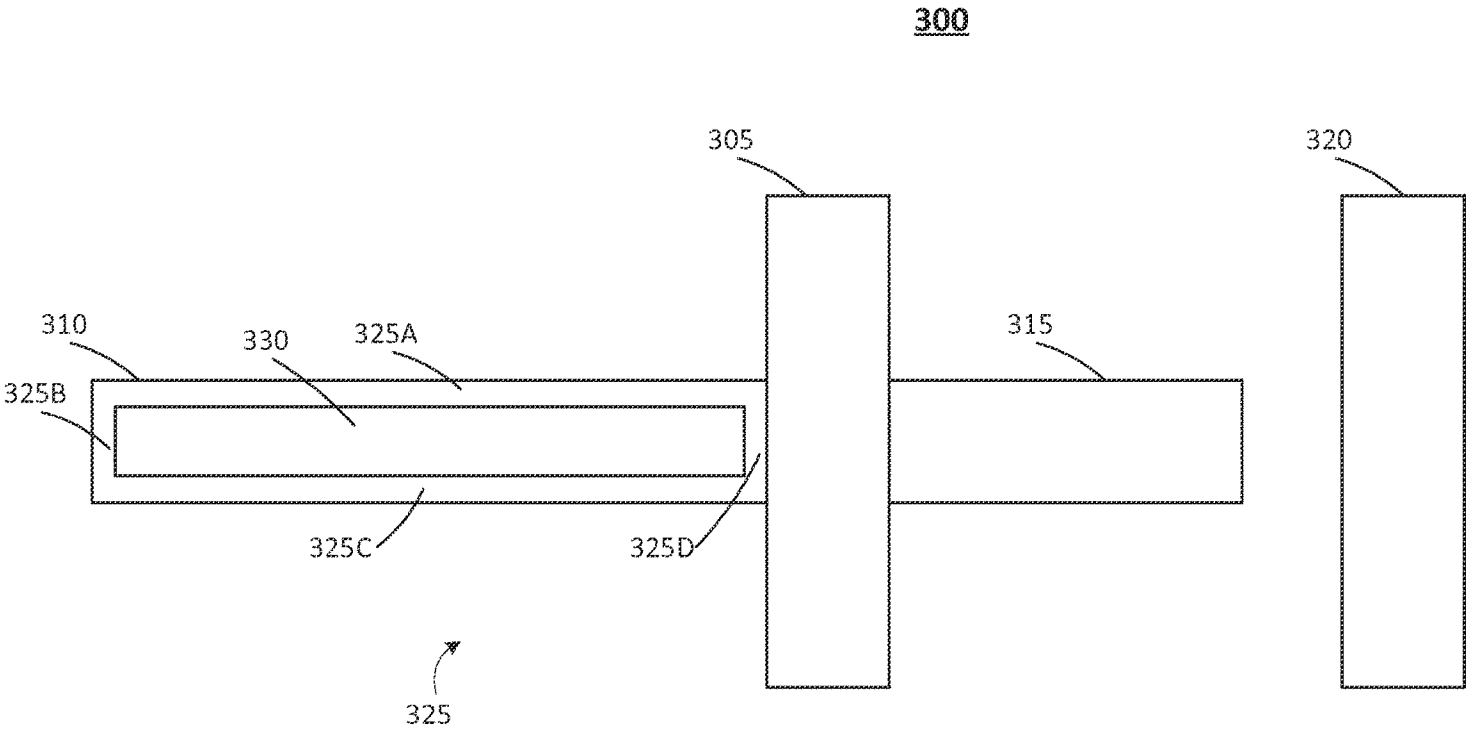

FIG. 3 illustrates still another block diagram of a connector 300 according to at least one example embodiment. As shown in FIG. 3, the connector 300 includes a base member 325 and a collar 320. The base member 325 includes a flange 305 and projection members 310 and 315. The connector 300 may be configured to help maintain at least one accessory coupled (e.g., moveably coupled) to a toy structure. Connector 300 may be configured to couple the accessory parallel to the toy structure. The collar 320 may be configured to help maintain at least one accessory coupled between the flange 305 and the collar 320. The projection member 310 may include a first section 325A, a second section 325B, a third section 325C, and a fourth section 325D. The first section 325A, the second section 325B, the third section 325C, and the fourth section 325D collectively form a void 330.

In an example implementation, one or more of the first section 325A, the second section 325B, the third section 325C, and the fourth section 325D may be optional. For example, the fourth section 325D may be omitted. In other words, the first section 325A and the third section 325C may extend directly into the flange 305. The projection member 310 may be configured to expand or contract in order to help maintain the connector 300 inserted into a toy structure. In other words, the first section 325A and the third section 325C are parallel (or substantially parallel) to each other. The first section 325A and the third section 325C may have a slight bow in an opposite direction to each other. The first section 325A and the third section 325C may compress or flex (e.g., into void 330) as the projection member 310 is inserted into the toy structure. Once inserted (or substantially inserted), the first section 325A and the third section 325C may expand which may help maintain the connector 300 inserted into the toy structure.

Figure 4:
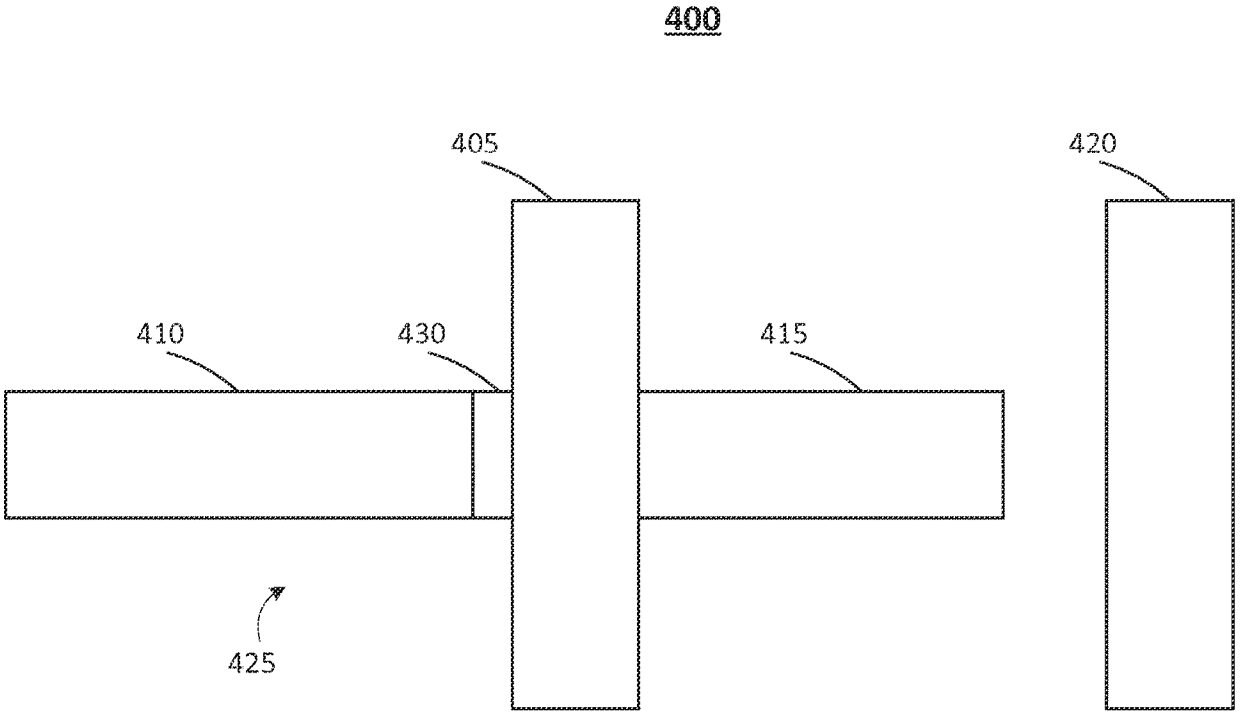

As shown in FIG. 4, the connector 400 includes a base member 425 and a collar 420. The base member 425 includes a flange 405 and projection members 410 and 415. The connector 400 may be configured to help maintain at least one accessory coupled (e.g., moveably coupled) to a toy structure. Connector 400 may be configured to couple the accessory parallel to the toy structure. The collar 420 may be configured to help maintain at least one accessory coupled between the flange 405 and the collar 420.

The projection member 410 may include a ring 430. The ring 430 may be configured to help maintain the connector 400 in a fixed position when the projection member 410 is inserted into a toy structure. For example, the ring 430 may include one or more ribs, protrusions, flats or planar surfaces and the like that, when in contact with the surface of the toy structure, prevent (or help prevent) the connector 400 from rotating with respect to the toy structure and/or help prevent the connector from falling out of the toy structure.

The elements, and description thereof, of FIGS. 1-4 may be combined in any number of configurations to form a connector according to example embodiments.

Figure 5:
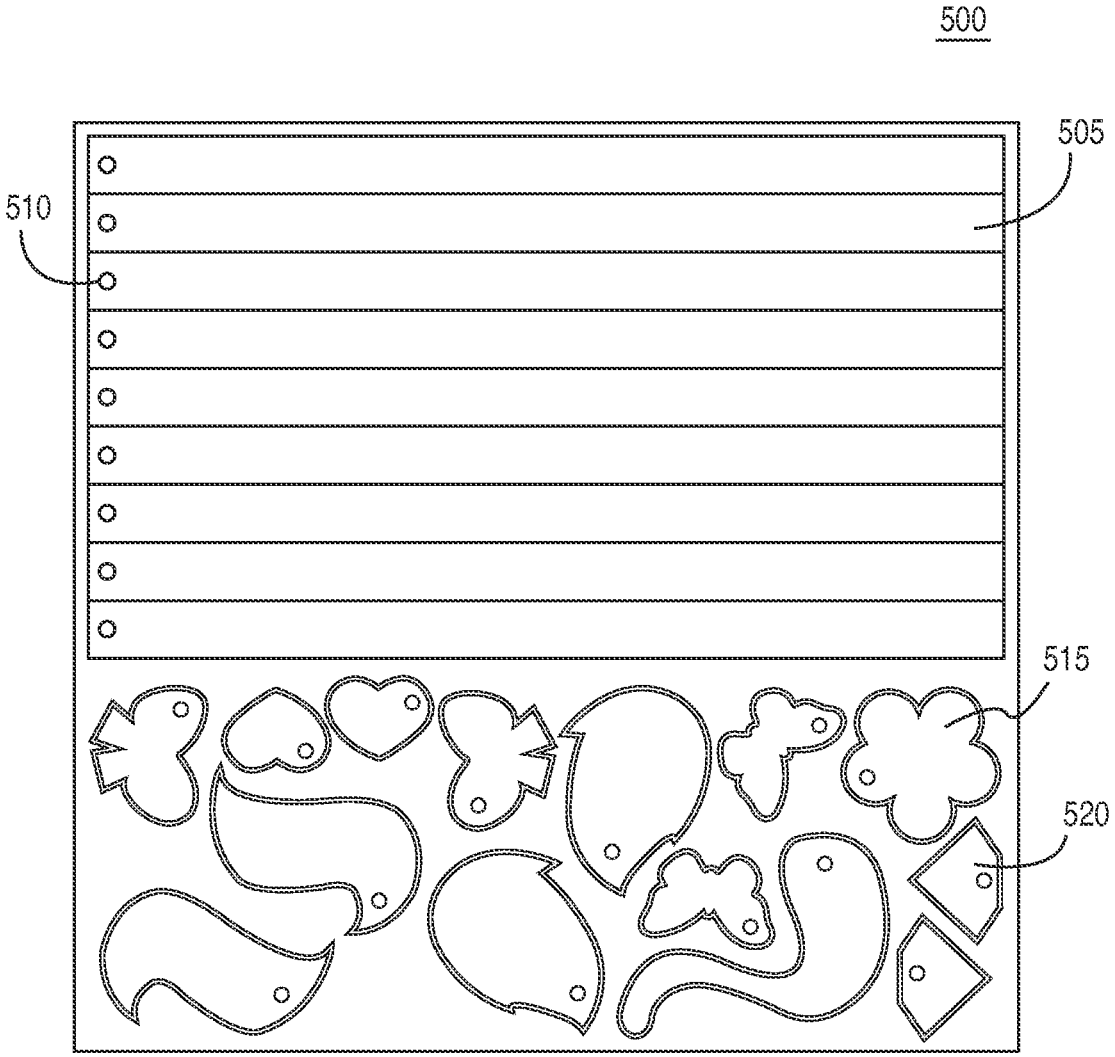
FIGS. 5 and 6 illustrate elements of toy structure kits according to at least one example embodiment.
Figure 6:
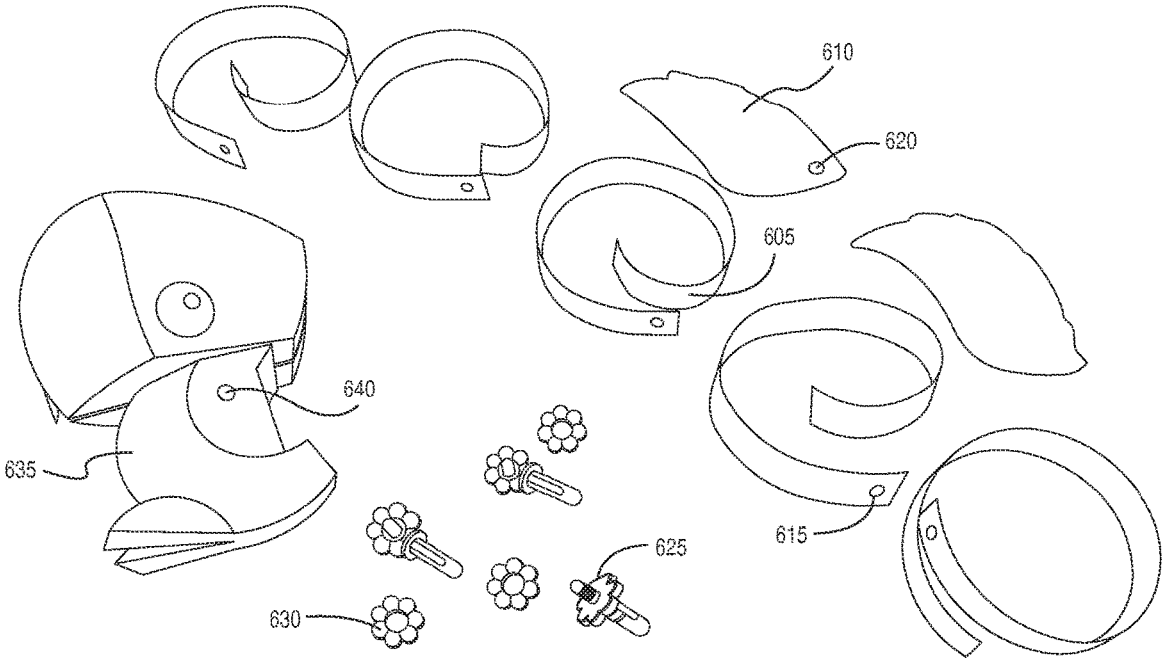

FIGS. 5 and 6 illustrate elements of toy structure kits according to at least one example embodiment. In the example shown in FIG. 5, a sheet 500 includes a plurality of a first type of accessory 505 and a plurality of a second type of accessory 515. Each of the first type of accessory 505 defines an opening 510 and each of the second type of accessory 515 includes an opening 520. Alternatively, opening 510 and/or 510 may be a slot, a punch-out, a hole, a slice, a channel, and the like. Each of the first type of accessory 505 and the second type of accessory 515 may be removed or separated from the sheet. For example, each of the first type of accessory 505 and/or the second type of accessory 515 may be separated by a perforation in the sheet. Each of the first type of accessory 505 and the second type of accessory 515 may include a marking (not shown). The marking may locate a spot that a finger, a connector (e.g., connector 100) or a tool may punch or push through. Punching or pushing through the spot located by the marking may form the opening 510, 520. Alternatively, or in addition, the first type of accessory 505 and/or the second type of accessory 515 may include a pre-formed opening 510, 520.

Each of the first type of accessory 505 are shown as rectangles strips that may be formed (into a shape) as desired by the user of the toy structure kit. For example, the first type of accessory 505 may be a formable shape. The formable shape is configured to be rolled, twisted, bent and/or the like. Each of the second type of accessory 515 are shown as preconfigured shapes (e.g., wings, bows, flowers, and the like) and may be used as shown or formed (while maintaining the general shape) as desired by the user of the toy structure kit. Any number of the first type of accessory 505 and/or the second type of accessory 515 may be combined, by the user of the toy structure kit, to form a toy accessory structure.

In the example shown in FIG. 6, a kit 600 includes a plurality of a first type of accessory 605 and a plurality of a second type of accessory 610. Each of the first type of accessory 605 includes an opening 615 and each of the second type of accessory 610 includes an opening 620. Each of the first type of accessory 605 are shown as rectangles formed as a loop. However, the first type of accessory 605 may be formed as desired by the user of the toy structure kit. For example, the first type of accessory 605 may be rolled, twisted, bent and/or the like. Each of the second type of accessory 610 are shown as preconfigured shapes (e.g., wings, bows, flowers, and the like) and may be used as shown or formed (while maintaining the general shape) as desired by the user of the toy structure kit. Any number of the first type of accessory 605 and/or the second type of accessory 610 may be combined, by the user of the toy structure kit, to form a toy accessory structure.

As shown in FIG. 6, the kit 600 includes a plurality of connectors 625, a plurality of collars 630 and a toy structure 635. The toy structure 635 includes an opening 640. The connectors 625 may be configured to help maintain at least one accessory (e.g., accessory 605, 610) coupled (e.g., moveably coupled) to the toy structure 635 at a position defined by opening 640. The collar 630 may be configured to help maintain at least one accessory (e.g., accessory 605, 610) coupled to the connector 625. Each of the first type of accessory 605, the second type of accessory 610 and the toy structure 635 may include a marking (not shown). The marking may locate a spot that a finger, a connector (e.g., connector 625) or a tool may punch or push through. Punching or pushing through the spot located by the marking may form a channel or opening thus forming the opening 615, 620, 640. Alternatively, or in addition, the first type of accessory 605, the second type of accessory 610 and/or the toy structure 635 may include a pre-formed opening 615, 620, 640.

The sheet 500 and the kit 600 may include one or more surfaces with an ornamental covering. The ornamental covering may be graphics (e.g., printed graphics) on the one or more surfaces. For example, the sheet 500 may include a first surface and a second surface. The sides including the first surface and the second surface may be configured to be placed in a first configuration such that the first surface is an outer surface and in a second configuration such that the second surface is an outer surface. In each configuration, the ornamental covering may differ based on a desired look for the toy assembled using the toy kit.

Figure 7:
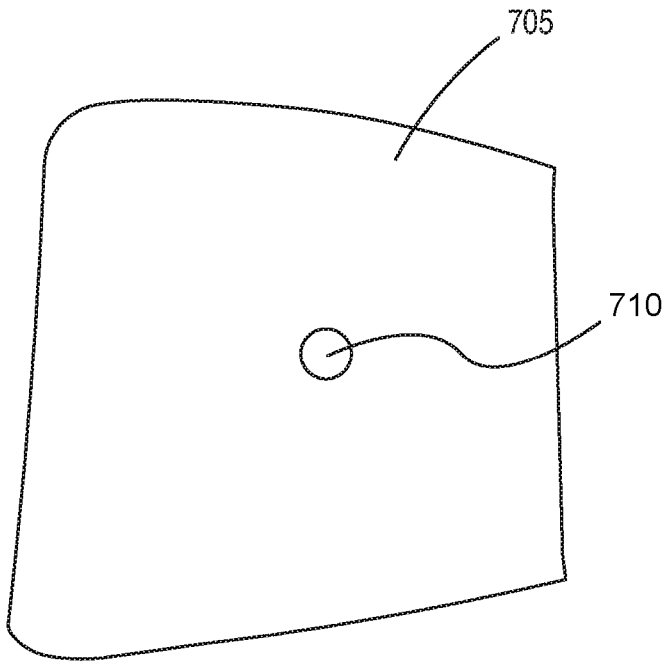
FIGS. 7, 8A and 8B illustrate perspective views of toy structures according to at least one example embodiment.
Figure 8A:
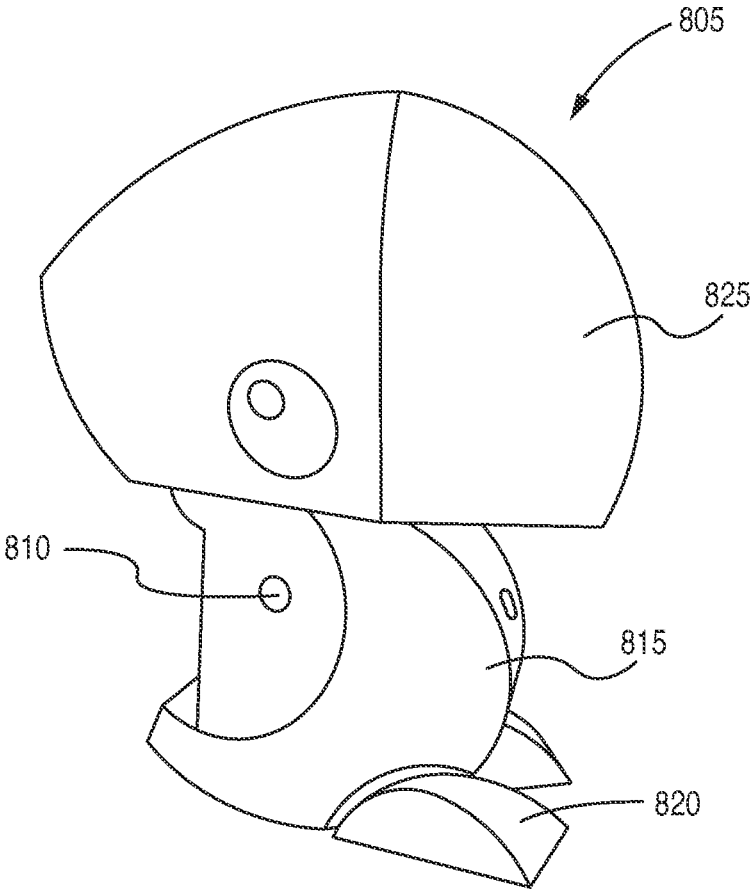
Figure 8B:
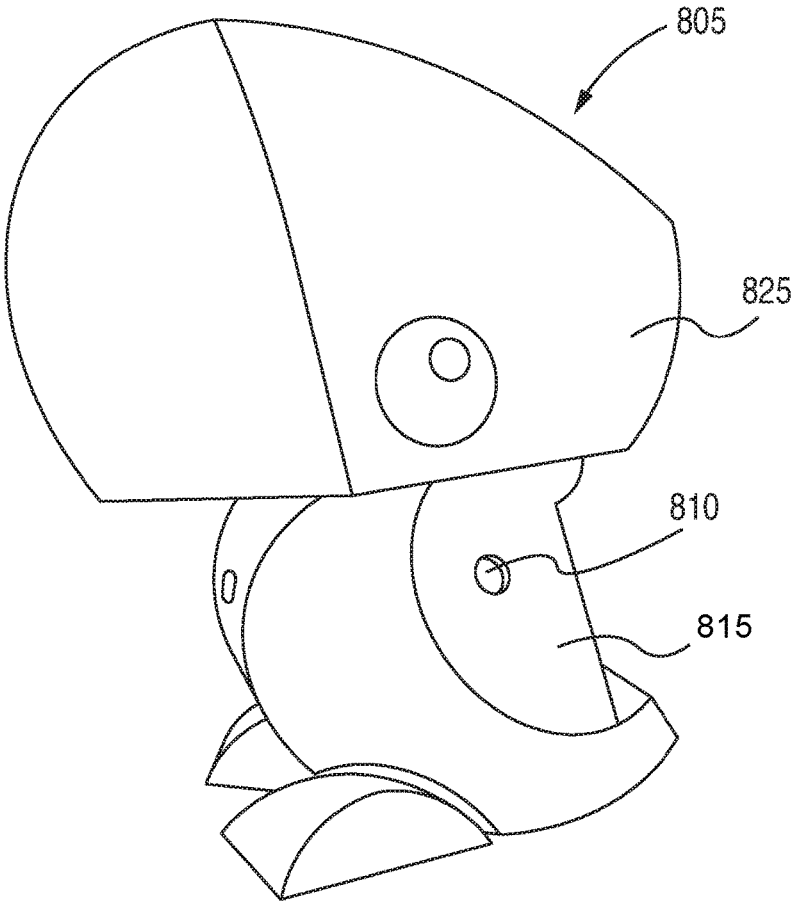

FIGS. 7, 8A and 8B illustrate perspective views of toy structures according to at least one example embodiment. As shown in FIG. 7, a portion of a toy structure 705 includes an opening 710. The toy structure 705 may be a three dimensional structure in the shape of a bird, a doll, an animal (e.g., dog or bear), a fish, and the like. The toy structure 705 may be hollow. The toy structure 705 may be made of any material such as cardboard, paperboard, paper or plastic. The toy structure 705 may be preformed and/or formed (e.g., assembled) by the user of the toy structure kit. The opening 710 may be preformed and prepositioned on the toy structure 705. The opening 710 may be formed (e.g., punched out) on the toy structure 705 by a user of the toy structure kit. In the illustrated embodiment, the opening 710 is formed in a circular shape. However, the opening 710 may be formed in a rectangular, square, circular, oval, spherical, rectangular prism, cylinder, and the like shape.

As shown in FIGS. 8A and 8B, a toy structure 805 includes, at least, a body 815, a foot 820, a head 825 and an opening 810. The toy structure 805 may be a three dimensional structure in any number of shapes. The toy structure 805 may be a hollow three dimensional structure. The toy structure 805 may be made of any material such as cardboard, paperboard, paper or plastic. The toy structure 805 may be preformed and/or formed (e.g., assembled) by the user of the toy structure kit. The toy structure 805 may be formed of multiple elements, pieces or sub-structures. For example, the body 815, the foot 820, and the head 825 may be separate structures that are assembled together to form the toy structure 805. The opening 810 may be preformed and prepositioned on the toy structure 805. The opening 810 may be formed (e.g., punched out) on the toy structure 805 by a user of the toy structure kit. In the illustrated embodiment, the opening 810 is formed in a circular shape. However, the opening 810 may be formed in a rectangular, square, circular, oval, spherical, rectangular prism, cylinder, and the like shape.

Figure 9A:
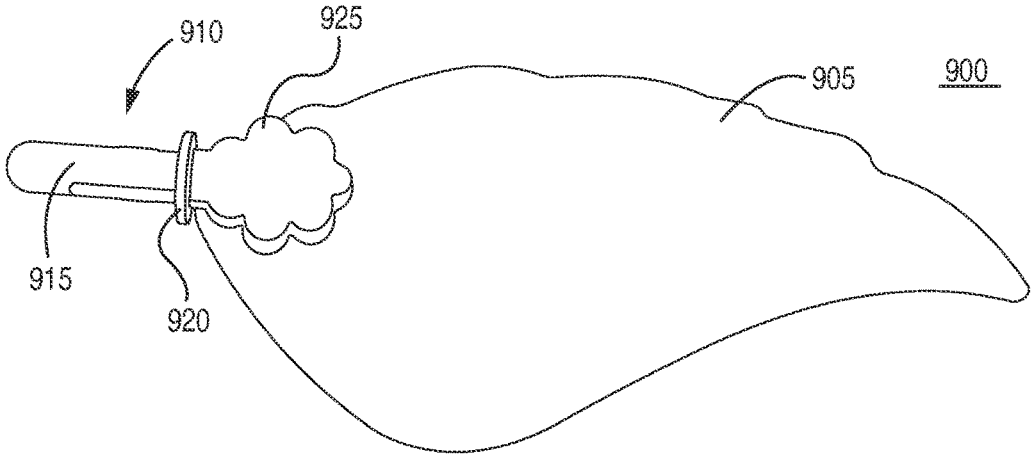
FIGS. 9A-9C and 10 illustrate perspective views of toy accessory structures according to at least one example embodiment.
Figure 9B:
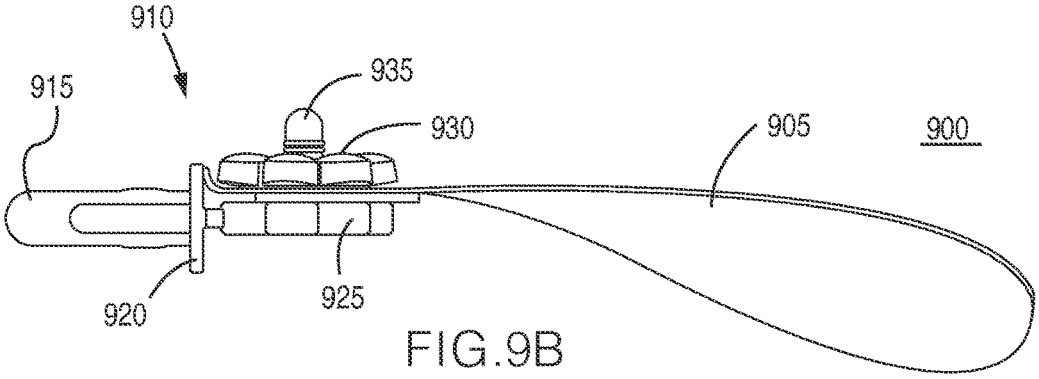
Figure 9C:
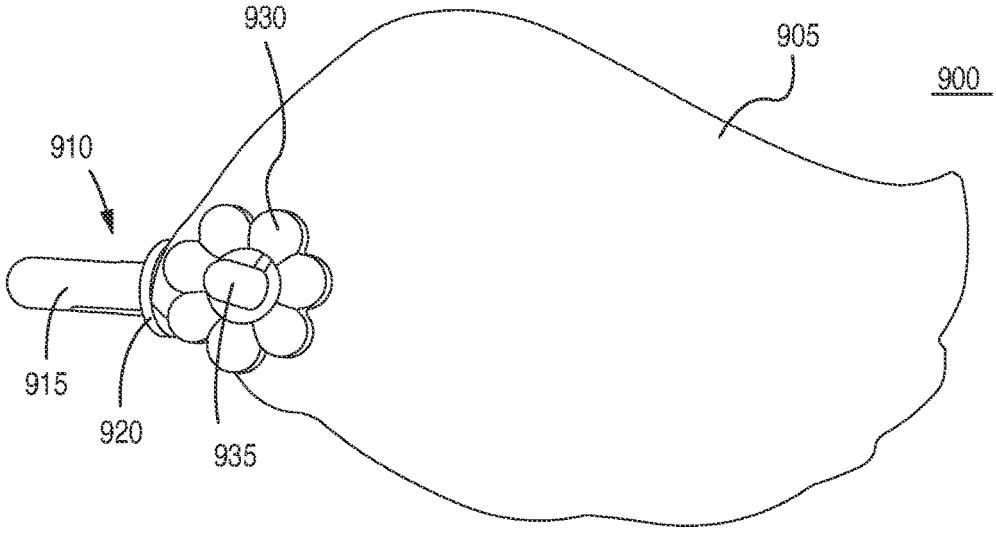

FIGS. 9A-9C and 10 illustrate perspective views of toy accessory structures according to at least one example embodiment. FIG. 9A is a perspective view of a first or back side of a toy accessory structure 900, FIG. 9B is a close-up view of a perspective view of a connector 910 of a toy accessory structure 900, and FIG. 9C is a perspective view of a second or front side of a toy accessory structure 900.

As shown in FIGS. 9A-9C, a toy accessory structure 900 includes an accessory 905 and a connector 910. The accessory 905 shown in FIGS. 9A-9C is a preconfigured shape (e.g., wings, bows, flowers, and the like) and may be used as shown or formed (while maintaining the general shape) as desired by the user of a toy structure kit. The connector 910 includes projection members 915, 935, flanges 920, 925 and collar 930. In the illustrated embodiment, the flange 925 and the collar 930 are formed in a flat flower petal shape. However, the flange 925 and the collar 930 may be formed in any shape such as a rectangle, square, circle, oval, sphere, rectangular prism, cylinder, and the like In the example implementation shown in FIGS. 9A-9C, a major surface of the accessory 905 is in contact with the flange 925. The accessory 905 is held in place between the flange 925 and the collar 930. In other words, connector 910 is configured as shown above with regard to connector 200 shown in FIG. 2. However, connector 910 could be configured as shown above with regard to connector 100 shown in FIG. 1. Although one accessory is shown, more than one accessory or any number of accessories may be held in place between the flange 925 and the collar 930. In the example implementation shown in FIGS. 9A-9C, the flange 920 may be configured as a stop when the connector 910 (e.g., projection member 915) is inserted into an opening associated with a toy structure (e.g., toy structure 805).

Figure 10:
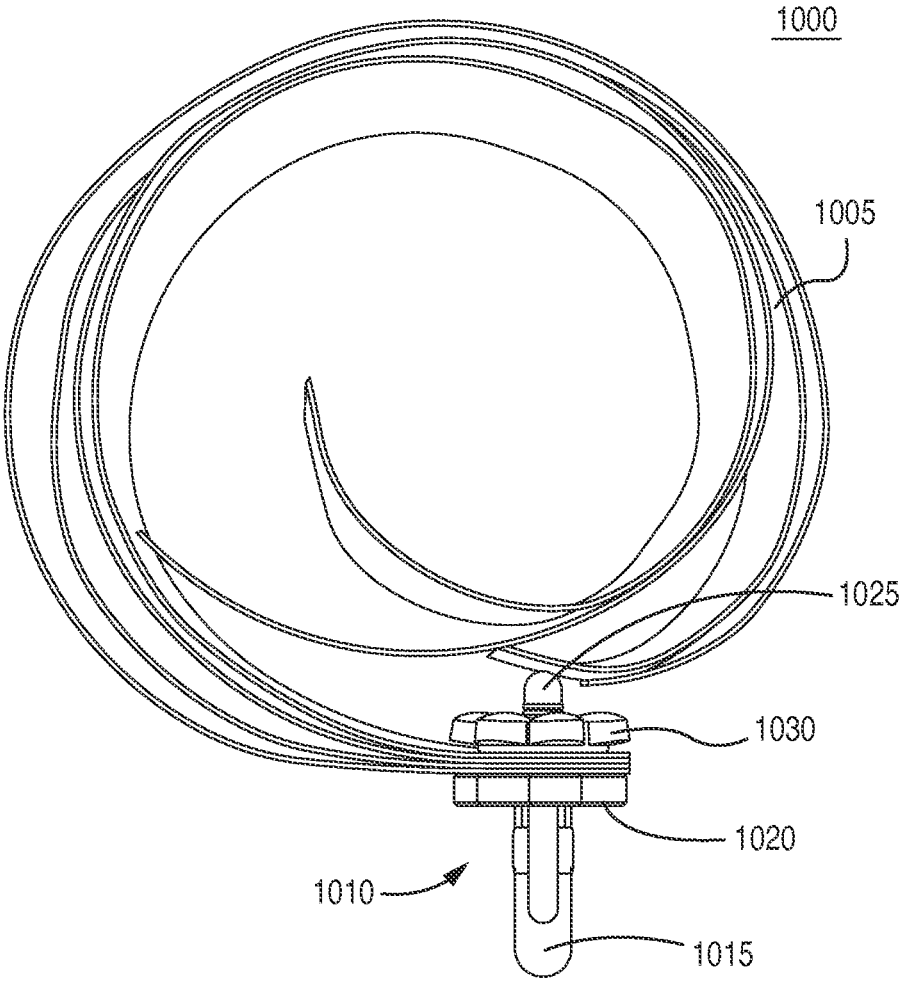

As shown in FIG. 10, a toy accessory structure 1000 includes an accessory 1005 and a connector 1010. The accessory shown in FIG. 10 is shown as a plurality of rectangle strips formed as a loop. However, the accessory 1005 may be formed as desired by the user of a toy structure kit. The connector 1010 includes projection members 1015, 1025, flange 1020 and collar 1030. In the example implementation shown in FIG. 10, a major surface of the accessory 1005 is in contact with the flange 1020. The accessory 1005 is held in place between the flange 1020 and the collar 1030. In other words, connector 1010 is configured as shown above with regard to connector 100 shown in FIG. 1. However, connector 1010 could be configured as shown above with regard to connector 200 shown in FIG. 2. In the example implementation shown in FIG. 10, the flange 1020 may also be configured as a stop when the connector 1010 (e.g., projection member 1015) is inserted into an opening associated with a toy structure (e.g., toy structure 805).

Figure 11A:
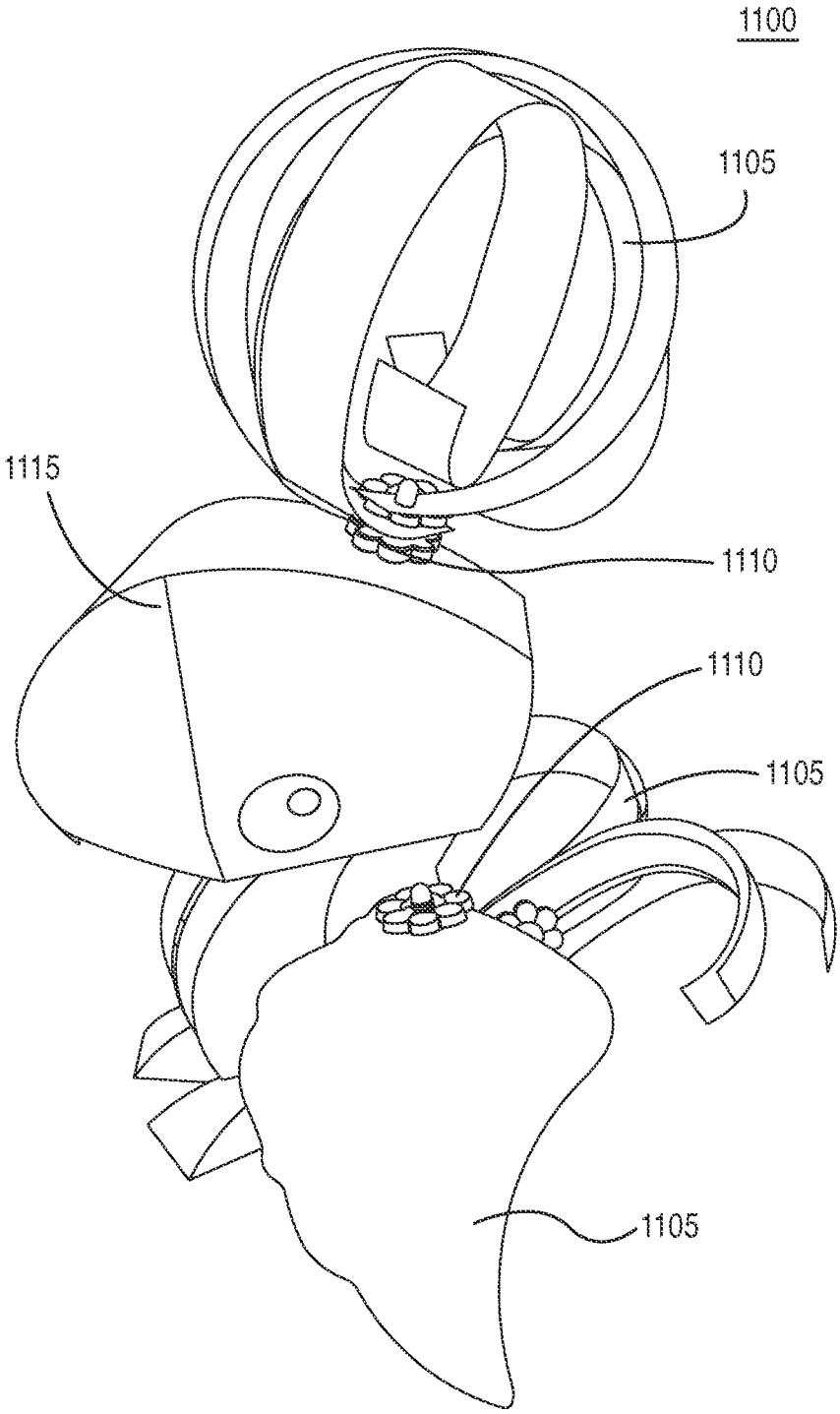
FIGS. 11A and 11B illustrate perspective views of assembled toy structures according to at least one example embodiment.
Figure 11B:
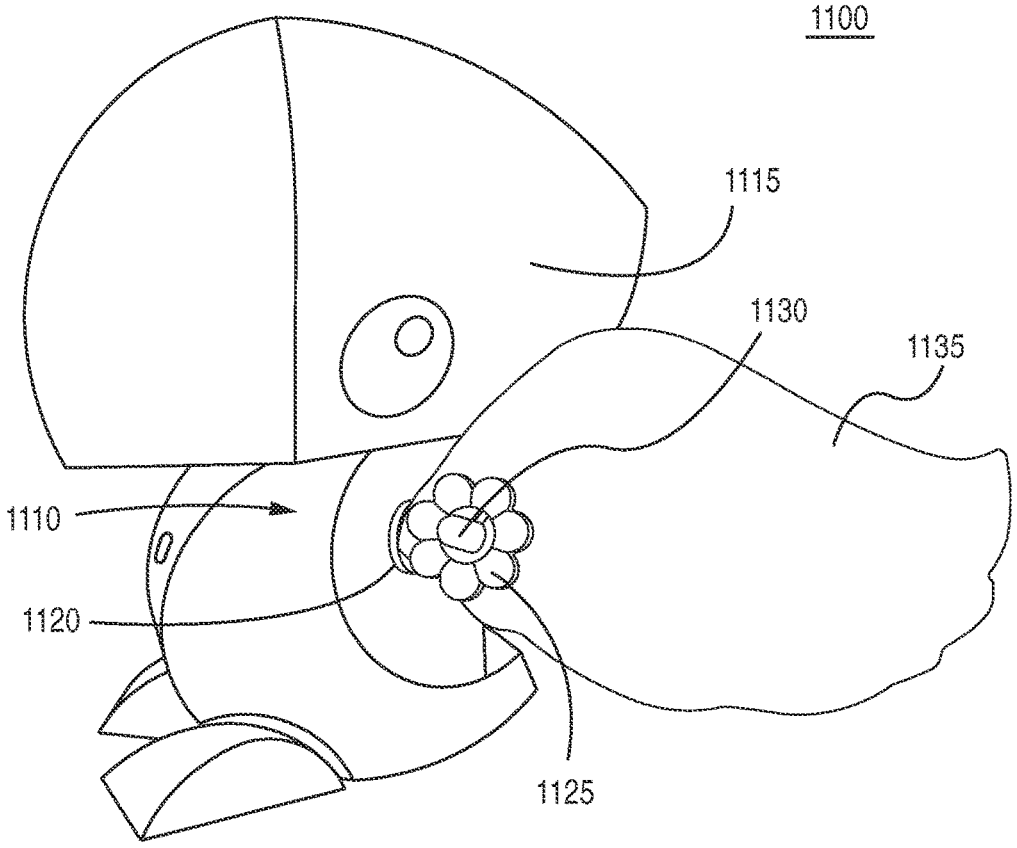
Figure 12A:
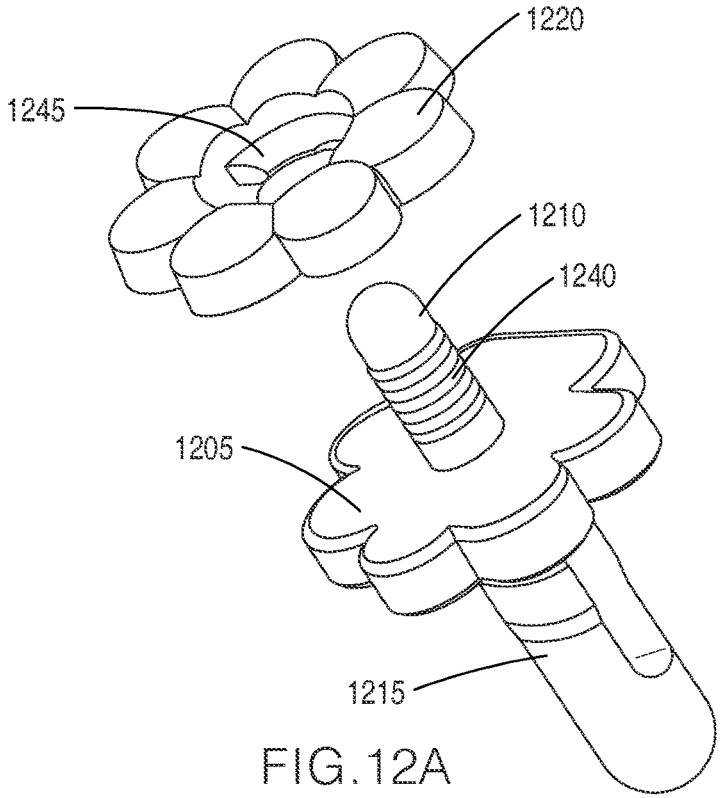
FIGS. 12A-E and 13A-D illustrate perspective views of connectors according to at least one example embodiment.
Figure 12B:
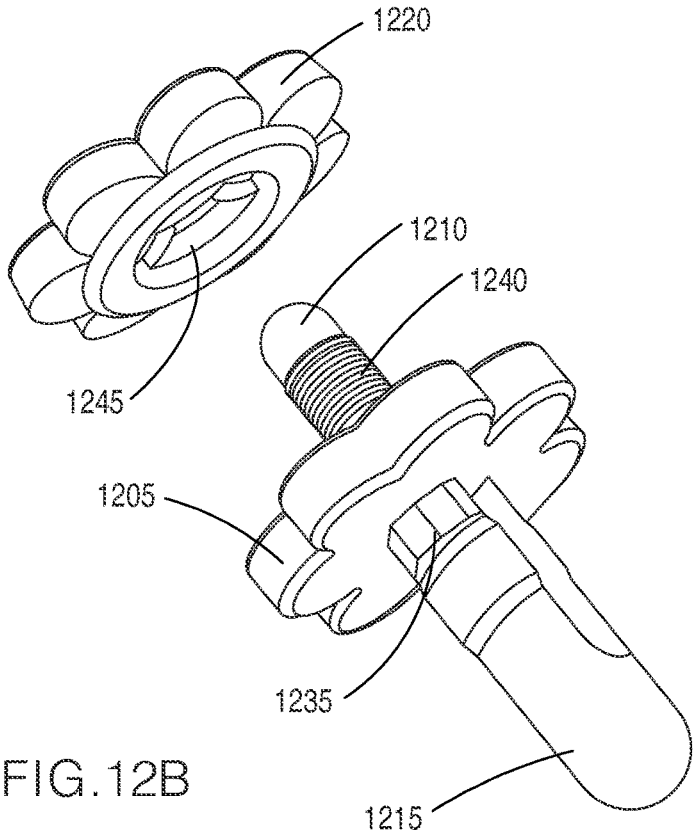
Figure 12C:
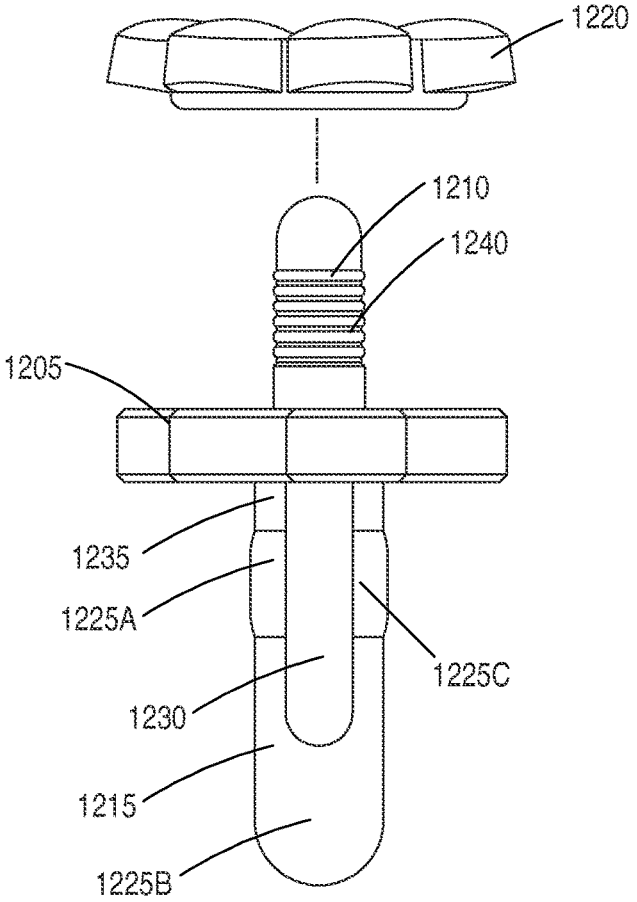
Figure 12D:
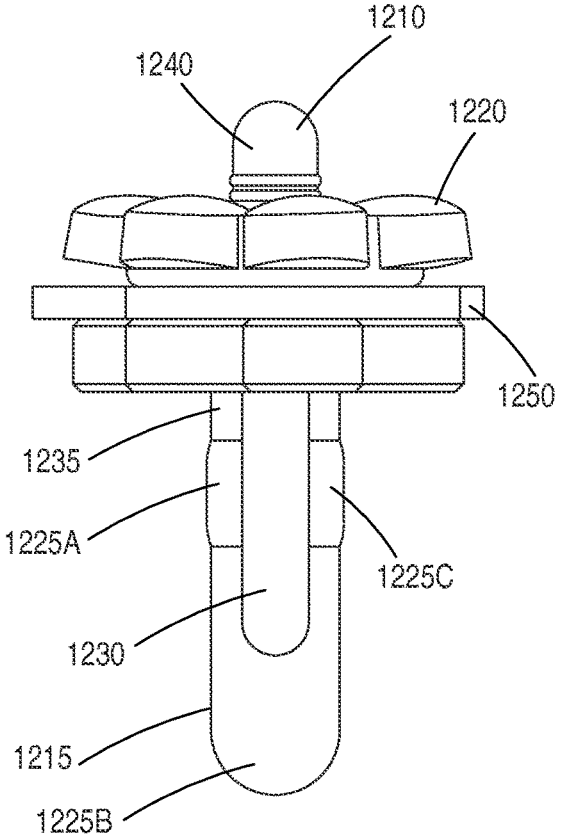
Figure 12E:
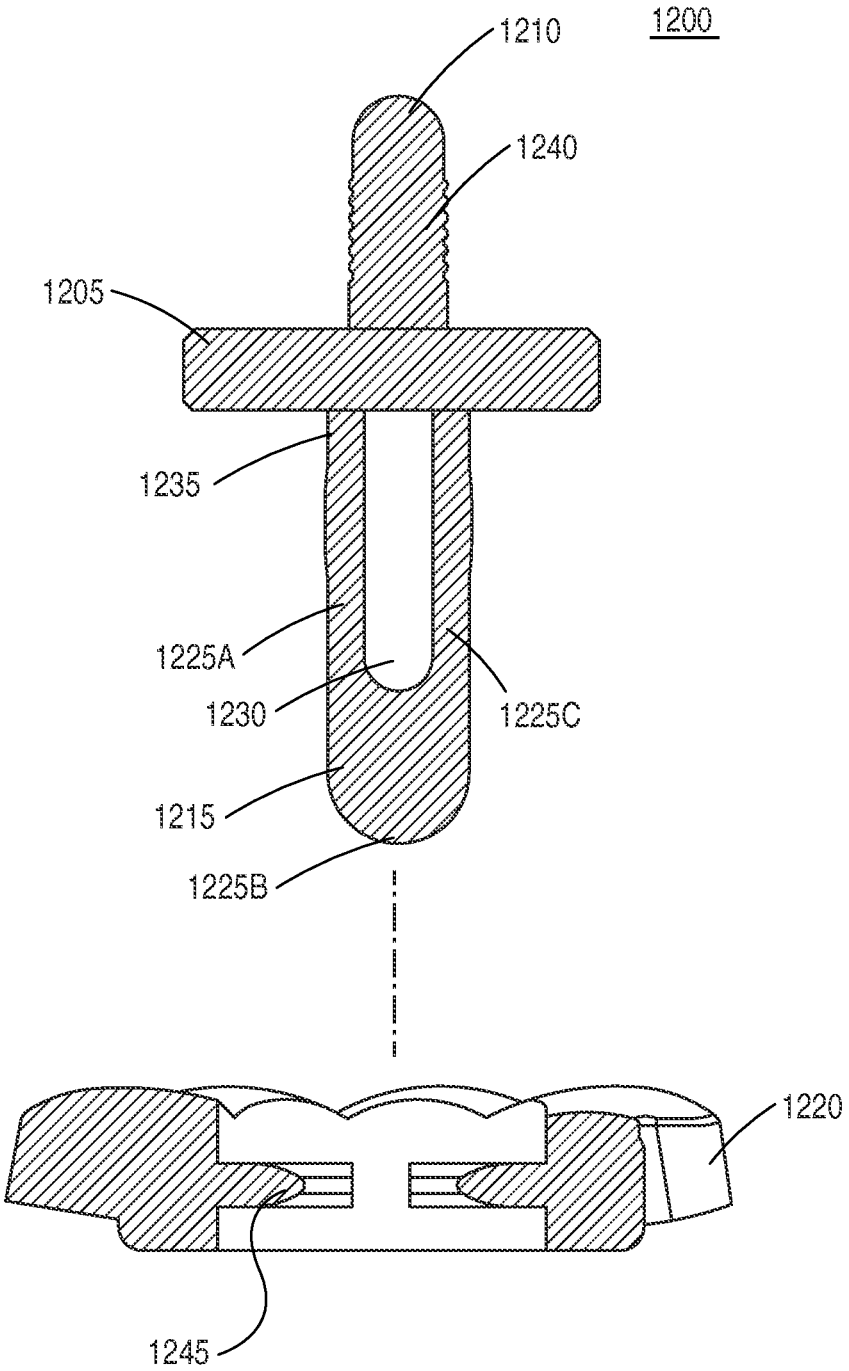

FIGS. 11A and 11B illustrate perspective views of an assembled toy structure according to at least one example embodiment. As shown in FIGS. 11A and 11B, the assembled toy structure 1100 includes a plurality of accessory structures 1105 coupled to a toy structure 1115 using a plurality of connectors 1110. The plurality of accessory structures 1105 may be one or more of the toy accessory structures, toy accessory structure 900, 1000, described in more detail above. The toy structure 1115 may be hollow. The toy structure 1115 may be made of cardboard, paperboard, paper or plastic. The toy structure 1115 may be preformed and/or formed (e.g., assembled) by the user of the toy structure kit. The toy structure 1115 may be formed of multiple elements, pieces or sub-structures. The plurality of connectors 1110 may be one or more of the connectors 100, 200, 300, 400 described in more detail above and/or one or more of the connectors 1200, 1300 described below.

FIG. 11B shows a close-up perspective view of assembled toy structure 1100. In the close-up perspective view of the assembled toy structure 1100, a connector 1110 is coupled to (e.g., a projection member (not shown) is inserted in) the toy structure 1115. The flange 1120 is shown as a stop (e.g., prevents the connector from further insertion) in contact with the toy structure 1115. Further, the accessory 1135 is coupled with the connector 1110 using projection member 1130 and held in place using collar 1125. The example illustrated in FIG. 11B shows the accessory 1135 extending away from (e.g., somewhat perpendicular to) the toy structure 1115. However, in another example implementation, using an alternately configured connector, the accessory may extend along (e.g., somewhat parallel to) the toy structure.

FIGS. 12 and 13 illustrate perspective views of connectors according to at least one example embodiment. FIGS. 12A-E illustrate a first configuration of a connector 1200. As shown in FIGS. 12A-E the connector 1200 includes a flange 1205, projection members 1210, 1215 and collar 1220. The connector 1200 may be configured to help maintain at least one accessory coupled (e.g., moveably coupled) to a toy structure. The collar 1220 may be configured to help maintain at least one accessory coupled between the flange 1205 and the collar 1220.

In the illustrated embodiment, the flange 1205 is formed in a flat flower petal shape. However, the flange 1205 may be formed in any shape such as a rectangle, square, circle, oval, sphere, rectangular prism, cylinder, and the like. In the illustrated embodiment, the projection members 1210, 1215 are formed in a cylindrical shape. However, the projection members 1210, 1215 may be formed in a tubular, rectangle, rectangular prism, cylindrical, and the like shape. In the illustrated embodiment, the collar 1220 is formed in a flat flower petal shape. However, the collar 1220 may be formed in any shape such as a rectangle, square, circle, oval, sphere, rectangular prism, cylinder, and the like.

The projection member 1215 may include a first section 1225A, a second section 1225B, and a third section 1225C. The first section 1225A, the second section 1225B, the third section 1225C, and the flange 1205 form a void 1230. The projection member 1215 may be configured expand or contract in order to help maintain the connector 1200 inserted into a toy structure (e.g., toy structure 805). In other words, the first section 1225A and the third section 1225C are parallel (or substantially parallel) to each other. The first section 1225A and the third section 1225C may have a slight bow in an opposite direction to each other. The first section 1225A and the third section 1225C may compress or flex or bend (e.g., into void 1230) as the projection member 1215 is inserted into the toy structure. Once inserted (or substantially inserted), the first section 1225A and the third section 1225C may expand (or return from the compression or flexing) to help maintain the connector 1200 inserted into the toy structure. Further, the void 1230 can allow for a lighter connector 1200 than a connector without a void.

The projection member 1215 further includes a ring 1235. The ring 1235 may be configured to help maintain the connector 1200 in a fixed position when the projection member 1215 is inserted into a toy structure (e.g., toy structure 805). For example, the ring 1235 may include ribs, protrusions, flat surfaces and the like that, when in contact with the surface of the toy structure, prevent (or help prevent) the connector 1200 from rotating and/or falling out of the toy structure. The ring 1235 may extend all the way around the projection member 1215. Alternatively, the ring 1235 may extend around a portion of the projection member 1215. In an example implementation, the ring 1235 includes flat surfaces. The flat surfaces may form the ring 1235 in a shape (e.g., square, hexagon, octagon, etc.). An edge (e.g., where two flat surfaces meet) can wedge into a surface in an opening in a toy structure (e.g., opening 810 on toy structure 805) thus applying a force that helps maintain the connector 1200 in a fixed position when the projection member 1215 is inserted into a toy structure. In another implementation, the opening can conform to the shape of the ring 1235 such that the ring 1235 engages all (or substantially all) of a surface in an opening in the toy structure.

In an example implementation, the accessory can be placed in a first fixed position when the connector 1200 is inserted into a toy structure. Then, the accessory can be rotated (e.g., placed in a rotational configuration) to a second fixed position and such that the ring 1235 engages a surface in an opening in the toy structure to maintain (or help maintain) the accessory in the second fixed position. In other words, the connector 1200 can be rotated in the opening of the toy structure by the user of the toy structure kit to change a position (e.g., rotational position) of the accessory.

The projection member 1210 includes at least one rib 1240. The at least one rib may also be a dimple, thread or the like. The collar 1220 may include a flexible flanges (or extensions) 1245, corresponding to the rib 1240, configured to engage the rib 1240. Alternatively and/or in addition, the collar 1220 may include an indent corresponding to the rib 1240 and configured to engage the rib 1240. In other words, rib 1240 may insert into the flexible flange 1245 when the collar 1220 is placed onto projection member 1210. The rib 1240 may be configured to help hold the collar 1220 in a position such that a portion of an accessory 1250 is held between the collar 1220 and the flange 1205. For example, the portion of an accessory 1250 (or accessories) may include an opening (not shown) that the projection member 1210 is inserted into. Then the collar 1220 may be pressed, threaded and the like onto the projection member 1210. As the collar 1220 is pressed onto the projection member 1210 the rib 1240 may be forced into the flexible flanges (or indent) 1245 thus holding the portion of an accessory 1250 between the collar 1220 and the flange 1205.

FIGS. 13A-D illustrate a second configuration of a connector 1300. As shown in FIGS. 13A-D the connector 1300 includes a flange 1305, 1355, projection members 1310, 1315 and collar 1320. The connector 1300 may be configured to help maintain at least one accessory coupled (e.g., moveably coupled) to a toy structure. The connector 1300 may be configured to the accessory in a different position than connector 1200 relative to the toy structure. The collar 1320 may be configured to help maintain at least one accessory (such as one, two, three, or any number of accessories) coupled between the flange 1305 and the collar 1320.

In the illustrated embodiment, the flange 1305 is formed in a flat flower petal shape. However, the flange 1305 may be formed in a rectangular, square, circular, oval, spherical, rectangular prism, cylinder, and the like shape. In the illustrated embodiment, the projection members 1310, 1315 are formed in a cylindrical shape. However, the projection members 1310, 1315 may be formed in a tubular, rectangle, rectangular prism, cylindrical, and the like shape. In the illustrated embodiment, the collar 1320 is formed in a flat flower petal shape. However, the collar 1320 may be formed in a rectangular, square, circular, oval, spherical, rectangular prism, cylinder, and the like shape.

The projection member 1315 may include a first section 1325A, a second section 1325B, and a third section 1325C. The first section 1325A, the second section 1325B, the third section 1325C, and the flange 1305 form a void 1330. The projection member 1315 may be configured to expand or contract in order to help maintain the connector 1200 inserted into a toy structure (e.g., toy structure 805). In other words, the first section 1325A and the third section 1325C are parallel (or substantially parallel) to each other. The first section 1325A and the third section 1325C may have a slight bow in an opposite direction to each other. The first section 1325A and the third section 1325C may compress (e.g., into void 1330) as the projection member 1315 is inserted into the toy structure. Once inserted (or substantially inserted), the first section 1325A and the third section 1325C may expand helping maintain the connector 1300 inserted into the toy structure.

Figure 13A:
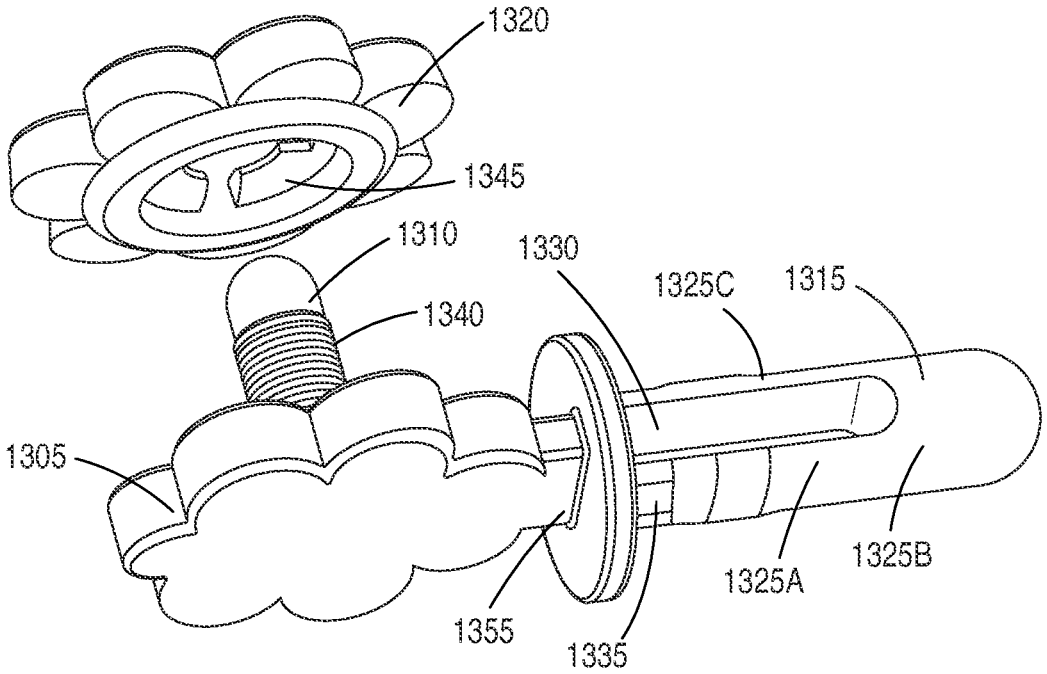
Figure 13B:
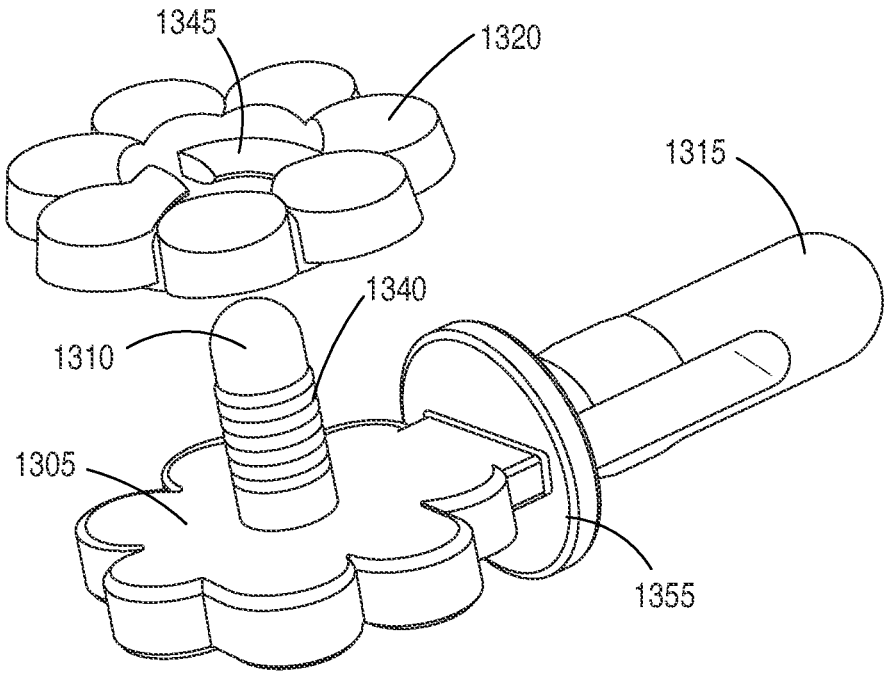
Figure 13C:
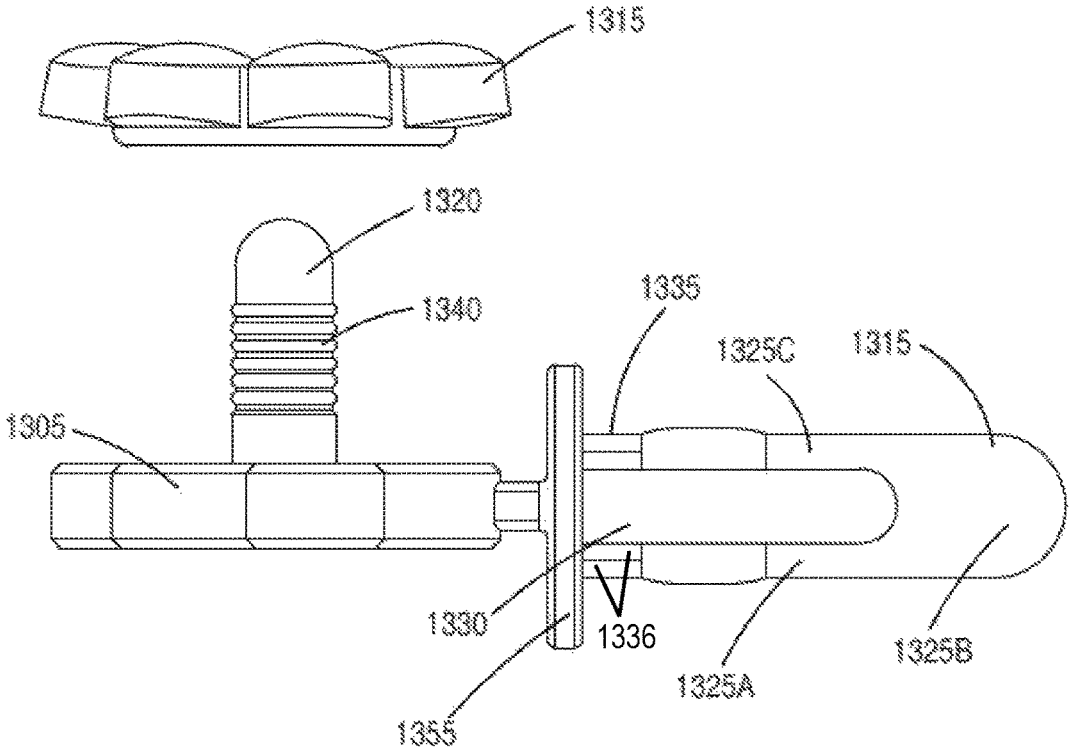
Figure 13D:
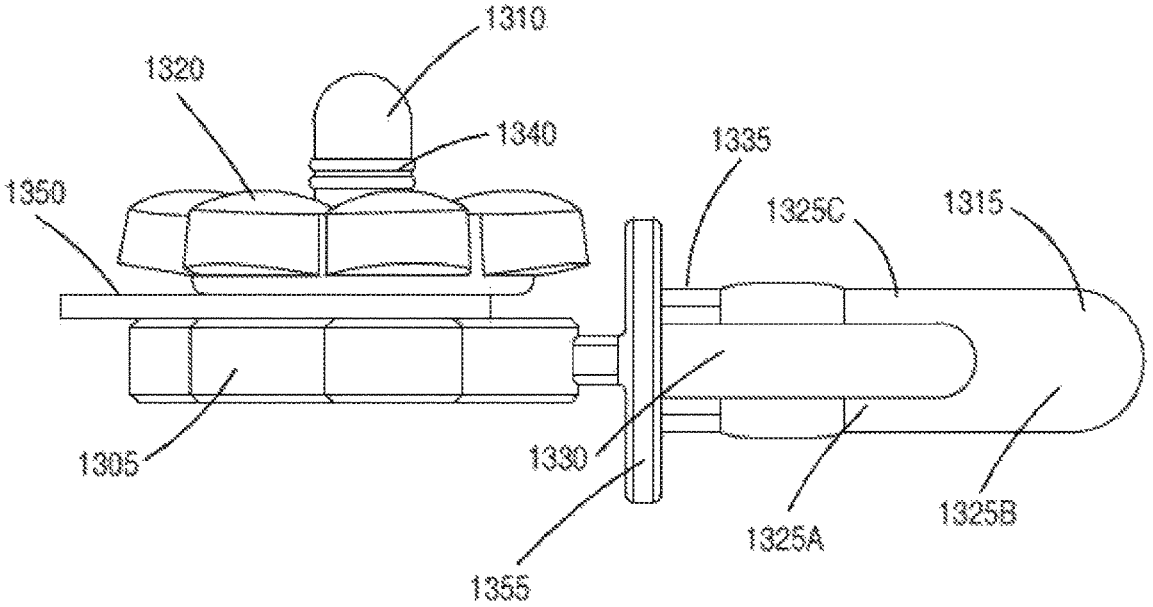

The projection member 1315 further includes a ring 1335. The ring 1335 may be configured to help maintain the connector 1300 in a fixed position when the projection member 1315 is inserted into a toy structure (e.g., toy structure 805). For example, the ring 1335 may include ribs, protrusions, flat surfaces, and the like, as indicated at 1336 in FIG. 13C, that, when in contact with the surface of the toy structure, prevent (or help prevent) the connector 1300 from rotating and/or falling out of the toy structure. As shown in FIGS. 13C and 13D, ribs or protrusions 1136 may face or extend outwardly. The ring 1335 may extend all the way around the projection member 1315. Alternatively, the ring 1335 may extend around a portion of the projection member 1315. The ring 1335 may be included on one or more of the first section 1325A and the third section 1325C.

The projection member 1310 includes at least one rib 1340. The at least one rib may also be a dimple, thread or the like. The collar may include an indent 1345 corresponding to the rib 1340. In other words, rib 1340 may insert into indent 1345 when the collar 1320 is placed onto projection member 1310. The rib 1340 may be configured to help hold the collar 1320 in a position such that a portion of an accessory 1350 is held between the collar 1320 and the flange 1305. For example, the portion of an accessory 1350 (or accessories) may include an opening (not shown) that the projection member 1310 is inserted into. Then the collar 1320 may be pressed, threaded and the like onto the projection member 1310. As the collar 1320 is pressed onto the projection member 1310 the rib 1340 may be forced into the indent 1345 thus holding the portion of an accessory 1350 between the collar 1320 and the flange 1305. The flange 1355 may be configured as a stop when the connector 1300 (e.g., projection member 1315) is inserted into an opening associated with a toy structure (e.g., toy structure 805).

As shown above, connectors 1200 and 1300 include rib 1240 and 1340 respectively. Rib 1240 and 1340 may be a series of (e.g., a plurality of, two or more, etc.) ribs. The series of ribs can be configured such that varying thicknesses or varying numbers of accessories can be retained by connectors 1200 and 1300. Accordingly, a different rib(s) can be engaged by the collar in order to retain the accessory (or accessories).

Further, a toy structure may have any number of openings. Therefore, connectors 1200 and 1300 can be inserted, removed and reinserted (e.g., in the same or another opening) as desired by the user of the toy structure kit. Accordingly, the projection member 1215, 1315 can be configured for repeated insertions into and removals from an opening in the toy structure. In addition, because a toy structure may have any number of openings, any number of accessories may be coupled (using a connector 1200, 1300) to the toy structure.

Figure 14:
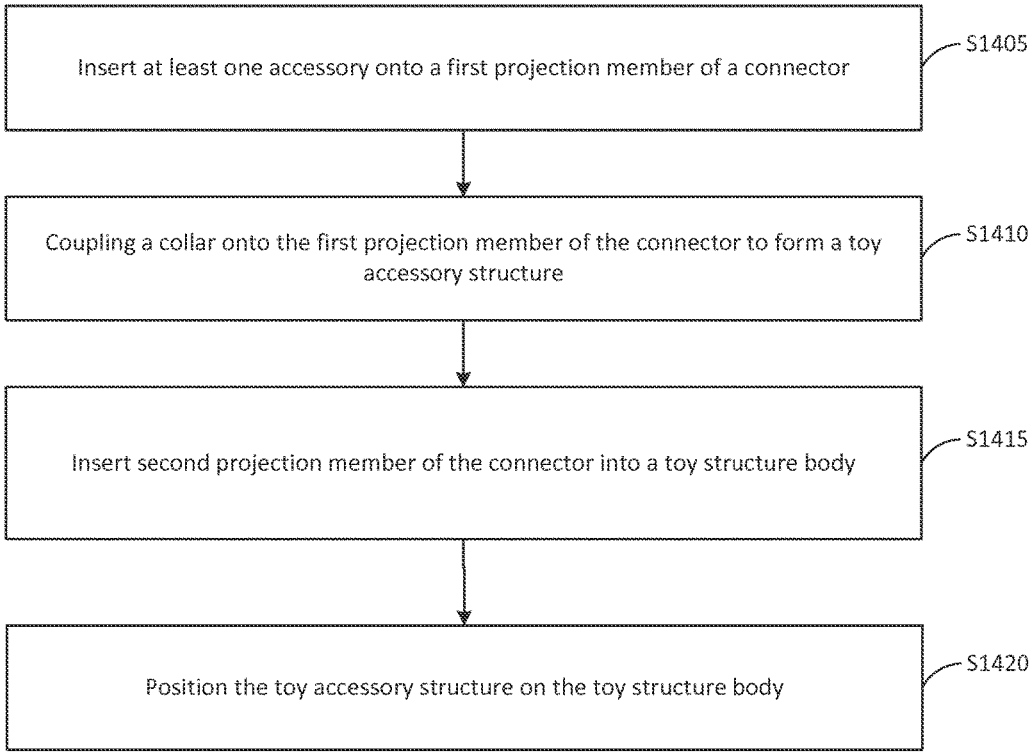
FIG. 14 illustrates a method of using a toy structure kit according to at least one example embodiment.

FIG. 14 illustrates a method of using a toy structure kit according to at least one example embodiment. As shown in FIG. 14, in step S1405 at least one accessory is inserted onto a first projection member of a connector. For example, an accessory as a preconfigured shape (e.g., wing, bow, flower, and the like) may include an opening through which a projection member of a connector is inserted. Alternatively, and/or in addition to, an accessory that can be formed as desired by the user of the toy structure kit may include an opening through which a projection member of a connector is inserted.

Next, in step S1410 a collar is coupled onto the first projection member of the connector to form a toy accessory structure. For example, a collar may include at least one flexible flange corresponding to at least one rib on the first projection member. As a user of the toy structure kit pushes the collar onto the first projection member, the rib is forced (or clicks) into the flexible flange. Thus, the collar is held in place on the first projection member. Alternatively, coupling the collar onto the first projection member can includes screwing the collar onto the first projection member. In this implementation, the rib and flexible collar can be threads. The connector and the accessory together (e.g., coupled together) form a toy accessory structure.

In step S1415 a second projection member of the connector is inserted into a toy structure body. For example, the toy structure body may include an opening through which the second projection member is inserted. As discussed above, the second projection member may be configured in such a way that the connector does not pull out of the toy structure body until a user desires to remove the connector from the toy structure body. In an example implementation, inserting the second projection member may include punching (e.g., pushing out a perforated portion of the toy structure body) the opening into the toy structure body using, for example, the second projection member.

In step S1420 the toy accessory structure is positioned on the toy structure body. For example, the toy accessory structure may be rotated into a desired position by the user of the toy structure kit. The toy accessory structure may be rotated into a desired position while the second projection member is inserted into a toy structure body. As discussed above, the second projection member may be configured to prevent rotation (or maintain a desired position) upon being positioned as desired by the user of the toy structure kit. Although the second projection member may be configured to prevent rotation upon being positioned, the toy accessory structure may be repositioned by the user of the toy structure kit by applying a requisite amount of rotational force or by removing (or partially removing) the toy accessory structure and repeating the above steps.

The method steps of FIGS. 12A-E may be repeated as necessary to construct toy structures as provided by the toy structure kit. For example, sheet 500 (described above with regard to FIG. 5, may include many accessory elements utilized to construct the toy structures illustrated in FIG. 11A by using the method described with regard to FIG. 14.

Some of the above example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, etc.

Specific structural and functional details disclosed herein are merely representative for purposes of describing example embodiments. Example embodiments, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "includes" and/or "including," when used herein, specify the presence of stated features, steps, operations, elements and/or components, but do not preclude the presence or addition of one or more other features, steps, operations, elements, components and/or groups thereof.

It should also be noted that in some alternative implementations, the functions/acts noted may occur out of the order noted in the figures. For example, two figures shown in succession may in fact be executed concurrently or may sometimes be executed in the reverse order, depending upon the functionality/acts involved.

Lastly, it should also be noted that whilst the accompanying claims set out particular combinations of features described herein, the scope of the present disclosure is not limited to the particular combinations hereafter claimed, but instead extends to encompass any combination of features or embodiments herein disclosed irrespective of whether or not that particular combination has been specifically enumerated in the accompanying claims at this time.

What is claimed is:

1. A toy structure kit, comprising:
an accessory defining an opening;
a toy structure defining an opening; and
a connector having a base member and a collar, the connector configured to couple the accessory to the toy structure, the base member including a first projection member and a second projection member, the first projection member configured to extend through the opening defined by the accessory and receive the collar, the second projection member configured to extend through the opening defined by the toy structure, wherein:
the second projection member includes a ring,
the ring includes at least one flat surface,
the ring is configured to fix a position of the at least one accessory when the second projection member is inserted into the toy structure, and
the ring includes a plurality of outwardly-facing ribs.

2. The toy structure kit of claim 1, wherein the at least one accessory is one of a formable shape and a preconfigured shape.

3. The toy structure kit of claim 1, wherein the at least one accessory is formed of paperboard including an ornamental covering.

4. The toy structure kit of claim 1, wherein the toy structure is a hollow three dimensional structure.

5. The toy structure kit of claim 1, wherein
the connector further includes a flange,
the first projection member is coupled to a first side of the flange,
the second projection member is coupled to a second side of the flange, opposite the first projection member, and
the flange is disposed perpendicular to the first projection member and the second projection member.

6. The toy structure kit of claim 1, wherein
the connector further includes a first flange and a second flange,
the second projection member is coupled to a first side of the first flange,
the first projection member is coupled to a first side of the second flange,
the second flange is coupled to a second side of the first flange opposite the second projection member,
the first projection member and the first flange are disposed parallel to each other, and
the first projection member and the second projection member are disposed perpendicular to each other.

7. The toy structure kit of claim 1, wherein
the first projection member includes one or more ribs,
the collar includes one or more flexible flanges, and
the one or more flexible flanges receive the one or more ribs when the first projection member is inserted into the opening defined by the collar.

8. The toy structure kit of claim 1, wherein
the second projection member includes at least three sections, and
the at least three sections are configured to help retain the second projection member in the toy structure.

9. The toy structure kit of claim 1, wherein
the second projection member includes at least three sections,
the at least three sections collectively define a void,
the void is configured to contract while inserting the second projection member into the toy structure, and the void is configured to expand to an original size when the second projection member is inserted into the toy structure.

10. The toy structure kit of claim 8, wherein two sections of the at least three sections are parallel to each other, and at least one other section of the at least three sections is perpendicular to the two sections.

11. The toy structure kit of claim 1, wherein the collar is distinct from the base member.

12. The toy structure kit of claim 1, wherein the ring extends all the way around the second projection member.

13. The toy structure kit of claim 1, wherein the ring extends around a portion of the second projection member.

14. The toy structure kit of claim 1, wherein the connector further includes a flange, the first projection member is coupled to a first side of the flange, and the second projection member is coupled to a second side of the flange, opposite the first projection member, wherein the accessory is disposed between the collar and the flange when the first projection member extends through the opening defined by the accessory and receives the collar.

15. A toy structure kit, comprising:

an accessory defining an opening;

a toy structure defining an opening; and a connector having a base member and a collar, the connector configured to couple the accessory to the toy structure, the base member including a first projection member and a second projection member, the first projection member configured to extend through the opening defined by the accessory and receive the collar, the second projection member configured to extend through the opening defined by the toy structure, wherein:

the second projection member includes a ring, the ring includes at least one flat surface, the ring is configured to fix a position of the at least one accessory when the second projection member is inserted into the toy structure, and the ring includes a plurality of outwardly-facing protrusions.

16. The toy structure kit of claim 15, wherein the connector further includes a flange, the first projection member is coupled to a first side of the flange, the second projection member is coupled to a second side of the flange, opposite the first projection member, and the flange is disposed perpendicular to the first projection member and the second projection member.

17. The toy structure kit of claim 15, wherein the connector further includes a first flange and a second flange, the second projection member is coupled to a first side of the first flange, the first projection member is coupled to a first side of the second flange, the second flange is coupled to a second side of the first flange opposite the second projection member, the first projection member and the first flange are disposed parallel to each other, and the first projection member and the second projection member are disposed perpendicular to each other.

18. The toy structure kit of claim 15, wherein the first projection member includes one or more ribs, the collar includes one or more flexible flanges, and the one or more flexible flanges receive the one or more ribs when the first projection member is inserted into the opening defined by the collar.

19. The toy structure kit of claim 15, wherein the second projection member includes at least three sections, the at least three sections collectively define a void, the void is configured to contract while inserting the second projection member into the toy structure, and the void is configured to expand to an original size when the second projection member is inserted into the toy structure, wherein two sections of the at least three sections are parallel to each other, and at least one other section of the at least three sections is perpendicular to the two sections.

20. The toy structure kit of claim 15, wherein the connector further includes a flange, the first projection member is coupled to a first side of the flange, and the second projection member is coupled to a second side of the flange, opposite the first projection member, wherein the accessory is disposed between the collar and the flange when the first projection member extends through the opening defined by the accessory and receives the collar.

* * * * *